US007354333B2

(12) United States Patent
Economikos et al.

(10) Patent No.: US 7,354,333 B2
(45) Date of Patent: Apr. 8, 2008

(54) DETECTION OF DIAMOND CONTAMINATION IN POLISHING PAD

(75) Inventors: Laertis Economikos, Wappingers Falls, NY (US); John A. Fitzsimmons, Poughkeepsie, NY (US)

(73) Assignee: International Business Machines Corporation, Armonk, NY (US)

( * ) Notice: Subject to any disclaimer, the term of this patent is extended or adjusted under 35 U.S.C. 154(b) by 205 days.

(21) Appl. No.: 10/905,816

(22) Filed: Jan. 21, 2005

(65) Prior Publication Data

US 2006/0166607 A1 Jul. 27, 2006

(51) Int. Cl.
*B24B 49/00* (2006.01)
*B24B 51/00* (2006.01)

(52) U.S. Cl. ..... 451/6; 451/8; 451/21; 451/56

(58) Field of Classification Search ..... 451/6, 451/8, 21, 56, 59, 72, 443
See application file for complete search history.

(56) References Cited

U.S. PATENT DOCUMENTS 4,919,533 A * 4/1990 Bowley et al. ..... 356/30
5,118,181 A * 6/1992 Yifrach et al. ..... 356/30
5,143,224 A * 9/1992 Burchell ..... 209/579
5,811,824 A * 9/1998 Smith et al. ..... 250/559.4
5,835,205 A * 11/1998 Hunter et al. ..... 356/30
6,241,587 B1 6/2001 Drill et al.
6,752,708 B1 6/2004 Kinoshita et al.
6,852,004 B2 * 2/2005 Chu et al. ..... 451/8
6,857,942 B1 * 2/2005 Lin et al. ..... 451/56
7,102,742 B2 * 9/2006 Geurts ..... 356/237.1
2002/0194790 A1 12/2002 Wang et al.
2004/0053567 A1 3/2004 Henderson
2004/0206453 A1 * 10/2004 Chu et al. ..... 156/345.12
2006/0025056 A1 * 2/2006 Henderson ..... 451/56

OTHER PUBLICATIONS

Guarnieri, C. R. et al., "Dry Patterning Process for Diamond-Particle Seed Layers," IBM Technical Disclosure Bulletin, Vol. 36, No. 4, Apr. 1993, pp. 35-37.

* cited by examiner

*Primary Examiner*—Timothy V. Eley
(74) *Attorney, Agent, or Firm*—Lisa U. Jaklitsch; Hoffman, Warnick & D'Alessandro LLC

(57) ABSTRACT

Methods for reconditioning a polishing pad and detecting diamond contamination of the polishing pad, are disclosed. In particular, the methods include the step of exposing the reconditioned polishing pad to an energy source to induce the diamond contamination to fluoresce. Detection of the diamond contamination is then made by detecting the fluorescence. Removal of the diamond contamination results in an improved reconditioned polishing pad. A reconditioning system for reconditioning a damaged polishing pad is also disclosed. The reconditioning system includes a reconditioning disk including a plurality of diamonds for reconditioning the polishing pad, wherein each diamond fluoresces when exposed to an energy source.

7 Claims, 3 Drawing Sheets

DETECTION OF DIAMOND CONTAMINATION IN POLISHING PAD

TECHNICAL FIELD

The present invention relates generally to chemical mechanical polishing, and more particularly, to methods of detecting diamond contamination of a polishing pad.

RELATED ART

Chemical mechanical polishing (CMP) is a method of removing layers of solid for the purpose of surface planarization and definition of metal interconnect patterns, and is a key process in back-end of line integrated circuit (IC) manufacturing. Typically, CMP is carried out using a revolving pad in a slurry to polish a semiconductor wafer. The polishing pad is made of a porous polymeric material that retains the slurry on or within the pad. During use, the polishing pad surface may become damaged, which prevents the polishing pad from providing consistent etching rates and makes the pad unusable. In order to address this situation, polishing pads are reconditioned by applying a reconditioning disk to the polishing pad that contains an abrasive in the form of diamonds. One problem with this process is that the diamonds oftentimes fall off the reconditioning disk and may become embedded in the polishing pad or otherwise contacted to the polishing pad, which results in catastrophic polishing scratches on a wafer being polished.

In view of the foregoing, there is a need in the art for methods of reconditioning a polishing pad and detecting diamond contamination thereof.

SUMMARY OF THE INVENTION

The invention includes methods for reconditioning a polishing pad and detecting diamond contamination of the polishing pad. In particular, the methods include the step of exposing the reconditioned polishing pad to an energy source to induce the diamond contamination to fluoresce. Detection of the diamond contamination is then made by detecting the fluorescence. Removal of the diamond contamination results in an improved reconditioned polishing pad. A reconditioning system for reconditioning a damaged polishing pad is also disclosed. The reconditioning system includes a reconditioning disk including a plurality of diamonds for reconditioning the polishing pad, wherein each diamond fluoresces when exposed to an energy source.

A first aspect of the invention is directed to a method of detecting diamond contamination of a polishing pad, the method comprising the steps of: causing at least part of the diamond contamination to fluoresce; and detecting the at least part of the diamond contamination by the fluorescence.

A second aspect of the invention includes a reconditioning system for reconditioning a damaged polishing pad, the reconditioning system comprising: a reconditioning disk including a plurality of diamonds for reconditioning the polishing pad, wherein every diamond on the reconditioning disk fluoresces when exposed to an energy source.

A third aspect of the invention related to a method of reconditioning a polishing pad, the method comprising the steps of: applying a reconditioning disk to the polishing pad, the reconditioning disk including a plurality of diamonds on a reconditioning surface, wherein at least one diamond contaminates the polishing pad during the applying step; exposing the polishing pad to an energy source to induce at least part of the diamond contamination to fluoresce; and detecting the at least part of the diamond contamination by the fluorescence.

The foregoing and other features of the invention will be apparent from the following more particular description of embodiments of the invention.

BRIEF DESCRIPTION OF THE DRAWINGS

The embodiments of this invention will be described in detail, with reference to the following figures, wherein like designations denote like elements, and wherein.

DETAILED DESCRIPTION

Figure 1:
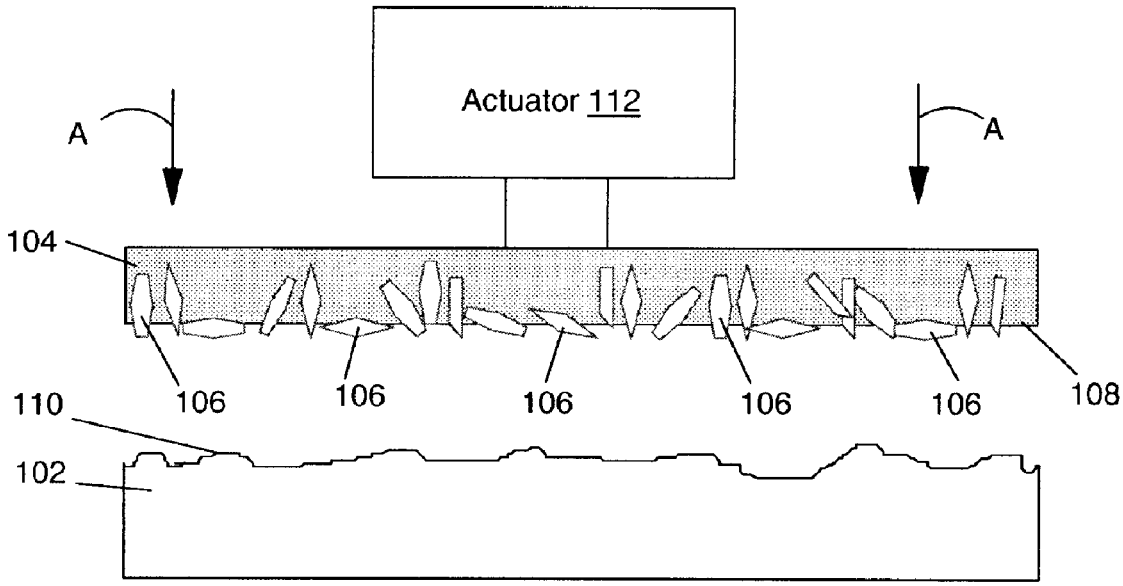
FIG. 1 shows a reconditioning disk and a polishing pad according to the invention.

With reference to the accompanying drawings, FIG. 1 shows a polishing pad 102 and a conventional reconditioning disk 104 including a plurality of diamonds 106 attached on a reconditioning surface 108 thereof. Polishing pad 102 includes a damaged surface 110 that makes polishing pad 102 unusable. Polishing pad 102 may be made of any now known or later developed porous polymeric material that retains a polishing slurry (not shown) on or within the pad. In order to correct damaged surface 110, reconditioning disk 104 is movably applied by actuator 112 to polishing pad 102, e.g., rotated and moved into contact with polishing pad 102 as shown by arrows A. Each diamond 106 typically has a size of no less than 70 μm and no greater than 250 μm.

Figure 2:
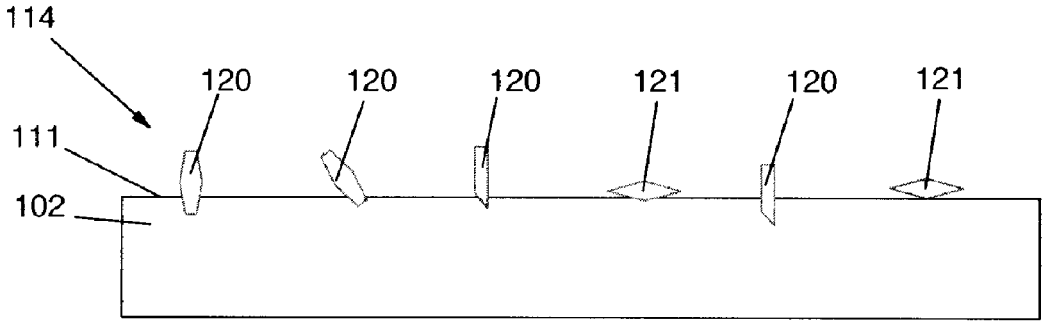
FIG. 2 shows a polishing pad including diamond contamination from the reconditioning disk of FIG. 1.

During application of reconditioning disk 104 to polishing pad 102, diamonds 106 can fall off of reconditioning disk 104 and become embedded in polishing pad 102 or otherwise contacted to polishing pad 102. Any such diamond 106 shall be referred to herein as "diamond contamination." FIG. 2 shows polishing pad 102 including diamond contamination 114 including, for example, at least one embedded diamond 120 in a reconditioned surface 111 thereof and/or at least one diamond 121 otherwise contacting polishing pad 102.

Figure 3:
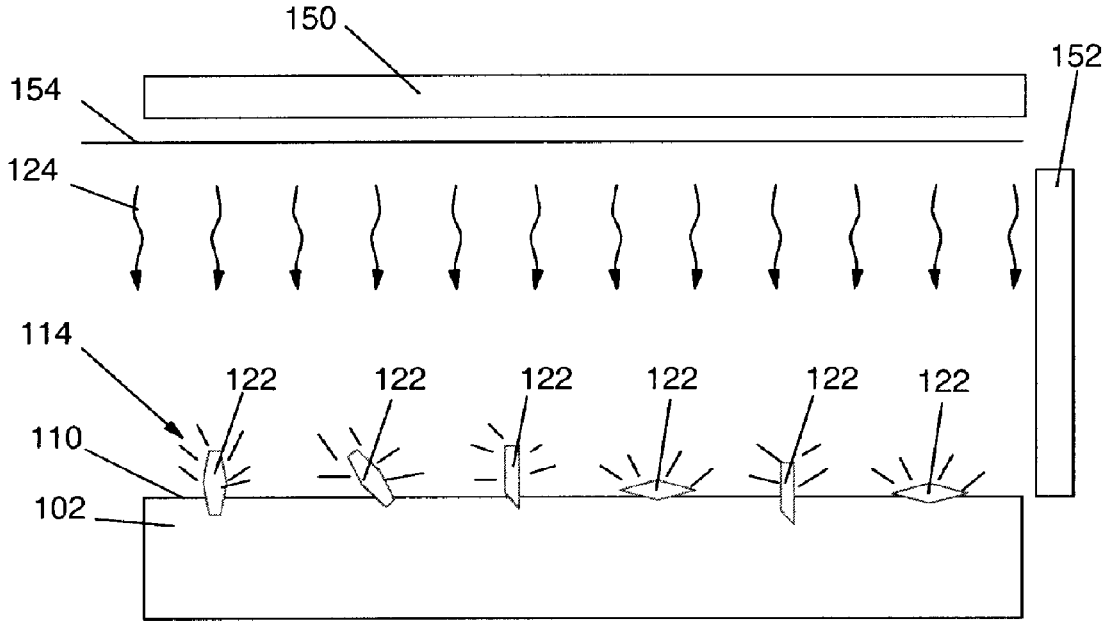
FIG. 3 shows exposure of the polishing pad of FIG. 2 to an energy source to induce the diamond contamination to fluoresce.

FIG. 3 shows the next step of the invention including causing (i.e., inducing) at least part of diamond contamination 114 (FIG. 2) to fluoresce, as shown by fluorescing diamonds 122. In particular, about 50% of diamonds produced have fluorescence that can be observed under special conditions such as short wavelength ultraviolet light. Further, about 10% of diamonds on the market have fluorescence strong enough to make a noticeable difference in the stone's color in incandescent light, which is low in ultraviolet light, and in sunlight or fluorescent light, which are high in ultraviolet light. In one embodiment, this step includes exposing (all or a portion of) the diamond contamination to an energy source 124. Energy source 124 preferably has a short wavelength, e.g., a wavelength of no less than 180 nm and no greater than 400 nm. Energy source 124 may expose diamond contamination 114 to a broad spectrum, such as 200 nm to 300 nm wavelength energy, or discrete wavelengths such as a spectral line of a mercury lamp. In one embodiment, energy source 124 is an ultraviolet light source. The exposure may also include some incandescent light, but typically this should be avoided as it makes the fluorescence harder to detect, and may require filtering. Other mechanisms to induce diamond contamination 114 to fluoresce may also be employed. For example, a mercury lamp, xenon lamp, laser, x-ray, etc., may be used, some of which may require filtering mechanisms for detection, as will be described below.

Next, as also shown in FIG. 3, any fluorescing diamond contamination 114 is detected by the fluorescence by a detector 150 or 152. Since energy is inherently lost in the fluorescence of diamond contamination 114, the detecting step includes detecting fluorescence having a wavelength of no less than the excitation source wavelength, e.g., no less than 200 nm and no greater than 600 nm. Energy source 124 and detector 150 or 152 are selected to allow detection of fluorescence by detector 150 or 152. For example, an appropriate detector 150 or 152 is selected depending on whether energy source 124 has a broad spectrum or discrete wavelengths. In one preferred embodiment, energy source 124 and a detector 152 are selected such that an excitation wavelength range of energy source 124 and a sensitivity wavelength range of detector 152 overlap minimally, e.g., approximately no more than 20 nm. The minimal detector/energy source spectrum overlap simplifies the requirement of the detector geometry since the detector (shown as detector 150 in FIG. 3) can be positioned substantially parallel to energy source 124, i.e., the beam, and polishing pad 102. However, if there is significant detector/energy source spectrum overlap, which results in detector noise background that decreases the sensitivity of the detector to small amounts of diamond contamination 114, then the position of the detector versus energy source 124 must be maintained such that minimal excitation radiation will reach the detector. For example, the detector may have to be placed substantially orthogonal to energy source 124 and/or polishing pad 102 in order to detect the fluorescence (shown as detector 152 in FIG. 3). In either case, fluorescence may be filtered by a filter 154 during the detecting step to prevent detection of noise and/or energy source 124. Although only two positions, i.e., substantially parallel or orthogonal, have been described, it should be recognized that the detector 150, 152 may be positioned at any angle desired to detect fluorescence.

As the detection occurs, the detected diamond contamination may be classified according to an extent of their fluorescence, e.g., by lumens. For example, fluorescing diamond contamination 124 may be classified into at least four classes including faint, medium, strong and very strong.

Figure 4:
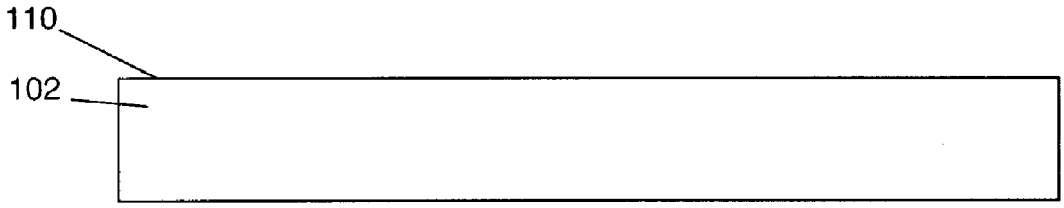
FIG. 4 shows a reconditioned polishing pad having the diamond contamination removed.

Next, as shown in FIG. 4, the diamond contamination is removed from polishing pad 102 in any now known or later developed manner. Alternatively, polishing pad 102 may be discarded if too much diamond contamination is present, and removal would cause too much damage to polishing pad 102.

Figure 5:
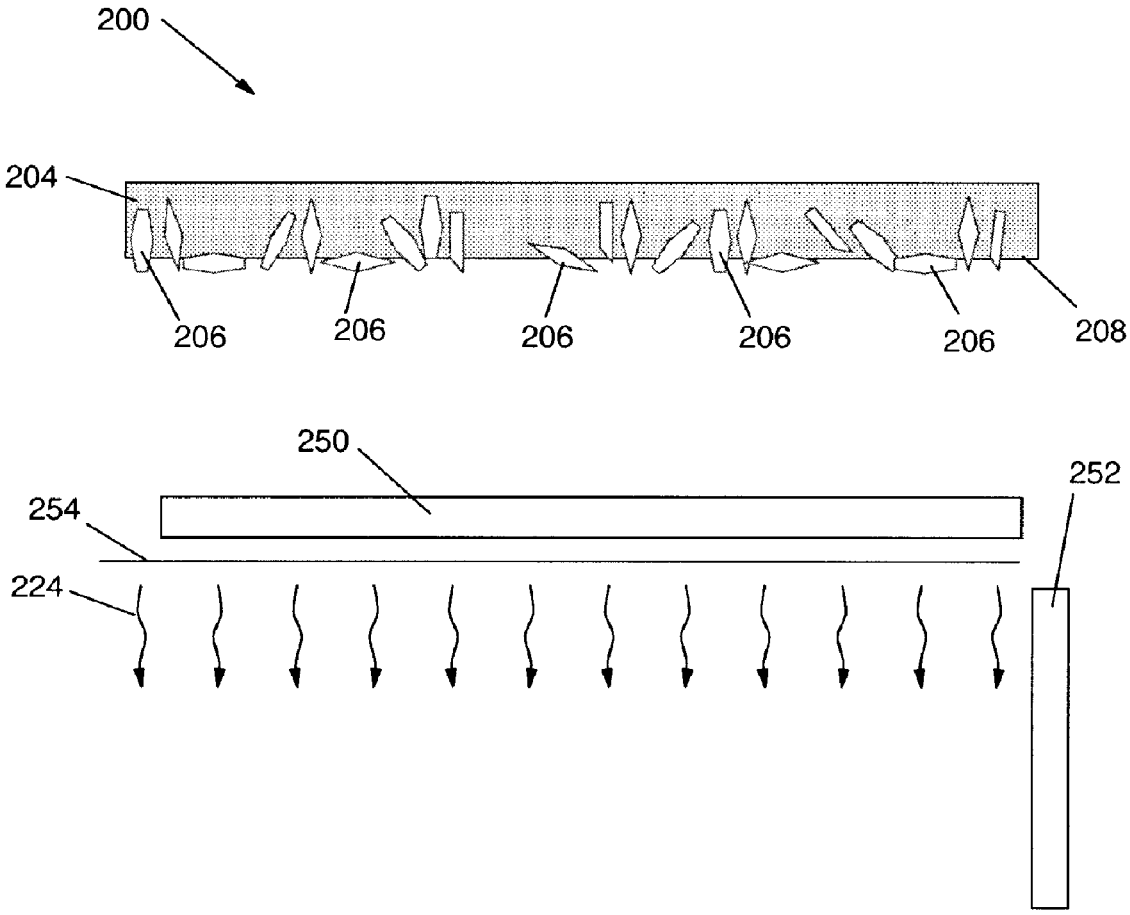
FIG. 5 shows a reconditioning system for a damaged polishing pad according to the invention.

Turning to FIG. 5, in order to improve the likelihood that diamond contamination is detected, the invention also includes a reconditioning system 200 for reconditioning a damaged polishing pad 102 (FIGS. 1-3) having a reconditioning disk 204 including a plurality of diamonds 206, wherein each diamond fluoresces when exposed to an energy source 224. Reconditioning disk 204 is applied to a damaged polishing pad 102 (FIGS. 1-3) for reconditioning damaged polishing pad 102 in any now known or later developed fashion. Reconditioning disk 204, in contrast to conventional disks however, includes only diamonds 206 that fluoresce when exposed to an energy source 224. In particular, as described above, only about 50% of diamonds produced have fluorescence that can be observed under special conditions such as short wavelength ultraviolet light. Further, about 10% of diamonds on the market have fluorescence strong enough to make a noticeable difference in the stone's color in incandescent light, which is low in ultraviolet light, and in sunlight or fluorescent light, which are high in ultraviolet light. Accordingly, while the above-described methods drastically improve reconditioning of a polishing pad 102 (FIGS. 1-4), some diamond contamination may not fluoresce, and therefore, may go undetected. A reconditioning disk 204, as shown in FIG. 5, according to the invention is provided with only diamonds 206 that fluoresce when exposed to an energy source 224, thus ensuring detection of any diamond contamination of polishing pad 102 (FIGS. 1-3). Diamonds 206 are attached to a reconditioning surface 208 of reconditioning disk 204 in any conventional or later developed fashion.

In one embodiment, diamonds 206 selected for use may be classified according to an extent of their fluorescence, e.g., by lumens. For example, diamonds 206 may be classified into at least four classes including faint, medium, strong and very strong. A desired extent of fluorescence can then be achieved. In addition, diamonds 206 may be selected to accommodate a particular energy source 224. For example, where a mercury lamp energy source 224 is used, diamonds 206 that fluoresce when exposed to that mercury lamp's particular spectral line can be selected. However, this feature is not necessary.

Continuing with FIG. 5, reconditioning system 200 also includes energy source 224 for causing diamond contamination of at least one diamond 122 (FIG. 3) of diamonds 206 embedded or contacting polishing pad 102 (FIG. 3) to fluoresce during exposure of the polishing pad by energy source 224. Energy source 224 may be structured and operate according to any one of the above-described embodiments. Reconditioning system 200 also includes a detector 250, 252 for detecting diamond contamination of polishing pad 102 (FIG. 2) by the fluorescence of at least one diamond of the plurality of diamonds 206 embedded or contacting the polishing pad. Detector 250, 252 may be structured and operate according to any one of the above-described embodiments. As described above, detector 250, 252 may be positioned to foster detection of fluorescing diamonds 122 (FIG. 3), e.g., in a plane substantially parallel, substantially orthogonal or any angle desired relative to energy source 124. As also explained above, an excitation wavelength range of energy source 224 and a sensitivity wavelength range of detector 250, 252 may overlap minimally. In one embodiment, energy source 224 has a wavelength of no less than 180 nm and no greater than 400 nm, and detector 250, 252 detects fluorescence having a wavelength of no less than 200 nm and no greater than 600 nm. A filter 254 may also be provided, where necessary, for filtering the fluorescence.

While this invention has been described in conjunction with the specific embodiments outlined above, it is evident that many alternatives, modifications and variations will be apparent to those skilled in the art. Accordingly, the embodiments of the invention as set forth above are intended to be illustrative, not limiting. Various changes may be made without departing from the spirit and scope of the invention as defined in the following claims.

What is claimed is:

1. A method of detecting diamond contamination of a polishing pad, the method comprising:

causing at least part of the diamond contamination to fluoresce; and detecting the at least part of the diamond contamination by the fluorescence, wherein the causing includes exposing the diamond contamination to an energy source; and wherein the energy source has a wavelength of no less than 180 nm and no greater than 400 nm.

2. The method of claim 1, wherein the detecting includes detecting fluorescence having a wavelength of no less than 200 nm and no greater than 600 nm.

3. The method of claim 1, further comprising selecting the energy source and a detector used during the detecting such that an excitation wavelength range of the energy source and a sensitivity wavelength range of the detector overlap minimally.

4. The method of claim 3, further comprising positioning the detector in a plane substantially parallel to the polishing pad.

5. A method of reconditioning a polishing pad, the method comprising:

applying a reconditioning disk to the polishing pad, the reconditioning disk including a plurality of diamonds on a reconditioning surface, wherein at least one diamond contaminates the polishing pad during the applying;

exposing the polishing pad to an energy source to induce at least part of the diamond contamination to fluoresce; and detecting the at least part of the diamond contamination by the fluorescence, wherein the energy source has a wavelength of no less than 180 nm and no greater than 400 nm, and the detecting includes detecting fluorescence having a wavelength of no less than 200 nm and no greater than 600 nm.

6. The method of claim 5, wherein the applying includes movably applying the reconditioning surface to a surface of the polishing pad.

7. The method of claim 5 further comprising positioning a detector, used during the detecting, in a plane substantially parallel to the energy source, in the case that the energy source has an excitation wavelength range that minimally overlaps with a sensitivity wavelength range of the detector.

* * * * *